US007975732B2

(12) United States Patent
Schoniger

(10) Patent No.: US 7,975,732 B2
(45) Date of Patent: Jul. 12, 2011

(54) DEVICE FOR HOLDING SACKS AND BAGS OPEN

(75) Inventor: Reinhard Schoniger, Numana (IT)

(73) Assignee: Italia Stampa s.r.l, Osimo (IT)

( * ) Notice: Subject to any disclaimer, the term of this patent is extended or adjusted under 35 U.S.C. 154(b) by 999 days.

(21) Appl. No.: 11/821,218

(22) Filed: Jun. 21, 2007

(65) Prior Publication Data

US 2008/0023596 A1 Jan. 31, 2008

(30) Foreign Application Priority Data

Jul. 31, 2006 (EP) ..... 06015890

(51) Int. Cl.
*B65B 1/04* (2006.01)
*B65B 67/04* (2006.01)

(52) U.S. Cl. ..... 141/316; 141/10; 141/114; 141/314; 141/315; 248/99

(58) Field of Classification Search ..... 141/10, 141/114, 314–316; 248/99–101
See application file for complete search history.

(56) References Cited

U.S. PATENT DOCUMENTS 3,697,030 A * 10/1972 Schultz ..... 294/1.1
4,530,533 A 7/1985 Dieter
4,664,348 A 5/1987 Cordant, III et al.
4,759,518 A 7/1988 Yardas
4,765,579 A 8/1988 Robbins, III et al.
4,832,291 A * 5/1989 Nelson et al. ..... 248/99
5,014,943 A * 5/1991 Nelson et al. ..... 248/99
5,308,027 A * 5/1994 Fullilove ..... 248/101
5,316,060 A 5/1994 Hodgdon et al.
6,431,503 B1 * 8/2002 Horan ..... 248/101
6,450,461 B1 9/2002 Lohmann
6,517,034 B1 * 2/2003 Kinchen ..... 248/99
6,874,797 B2 4/2005 Gardenouer

FOREIGN PATENT DOCUMENTS

DE 29900563 3/1999

* cited by examiner

*Primary Examiner* — Timothy L Maust
(74) *Attorney, Agent, or Firm* — Irving M. Fishman

(57) ABSTRACT

A device (1) for holding sacks open, with a frame (2), wherein the frame (2) forms the opening (5) of the device (1) for holding sacks open, and the opening (5) can be closed by means of a cover element (3), which is mounted in a pivotable manner on the frame (2), the frame (2) having at least one guide element (**2*a*), by means of which the cover element (3) can be moved from a first position into a second position, wherein the cover element (3) in the first position can be pivoted and optionally closes or exposes the opening (5) of the frame (2), and in the second position the cover element (3) serves as a ramp over the side web (2*j*) of the frame (2), lying on the ground, and is held on the frame (2**) in a manner secure against rotation.

36 Claims, 12 Drawing Sheets

DEVICE FOR HOLDING SACKS AND BAGS OPEN

CROSS-REFERENCE TO RELATED APPLICATION

Not applicable

STATEMENT REGARDING FEDERALLY SPONSORED RESEARCH OF DEVELOPMENT

Not Applicable

THE NAMES OF THE PARTIES TO A JOINT RESEARCH AGREEMENT

Not applicable

INCORPORATION-BY-REFERENCE OF MATERIAL SUBMITTED ON A COMPACT DISC

Not Applicable

BACKGROUND OF THE INVENTION

1. Field of the Invention

The present invention relates to a device for holding sacks and bags open in accordance with the preamble to Claim 1.

2. Description of Related Art Including Information Disclosed Under 37 CFR 1.97 AMD 1.98

Sacks and bags are frequently used to accommodate objects. Known examples are rubbish sacks, sacks for garden waste, packing waste, and the like. Each of these sacks forms a space for accommodating these objects, which, for example, are accommodated in these sacks for the purpose of transport or disposal. As materials for these accommodation sacks or bags, use may be made, for example, of textile materials, plastics, or nets. These different materials have in common the fact that they are flexible. The sack materials therefore do not form a solid body, with the result that an unfilled sack collapses in on itself. No objects can be filled into such a sack which has collapsed. Rather, it is necessary for this sack to be positioned in some way in such a manner that its opening is under tension. For example, a person is required to hold the sack open while a second person fills objects into it. Proposals have already been made for generic devices to position an accommodation sack in such a position when there is no person available to open the sack. These generic devices comprise, for example, as spreader elements, frames which can be inserted into the opening of the sacks. The opening edge of a sack can, for example, be guided to the outside or inside over a frame, and folded around the frame edges.

With regard to a device for the accommodation of objects, preferably of refuse, in particular of leaves and/or earth, with the device from DE 29900563 U1 a ramp is secured to the frame which opens the opening of the sack, so that the sack lying on the ground can be filled by the second hand of the person, while they hold the frame with the other. A drawback of the device according to DE 29900563 U1 is the fact that the device must be held by hand so that the frame stands perpendicular to the ground. If the frame is not held firmly, it falls over and the frame opening lies on the ground and the sack can no longer be filled.

U.S. Pat. No. 6,450,461 discloses a device similar to that of DE 29900563 U1 described heretofore. From U.S. Pat. No. 6,874,797 B2 a further device is known in which a sack is held open, this device having very large dimensions and the device is therefore not flexible and cannot, for example, be used in the garden.

U.S. Pat. No. 5,316,060 likewise discloses a device for holding sacks or bags open, in which the sack or bag is tensioned by two walls held parallel to one another, which are pushed into the sack, a further plate, perpendicular to the two plates being held and pushed into the sack, serving to keep the two perpendicular plates at a distance from one another and at the same time serving as a ramp. The wall elements pushed into place can be replaced by U-shaped tubular structures. The ramp can additionally be arranged in accordance with FIG. 1 of U.S. Pat. No. 5,316,060 so as to be capable of pivoting to one side of the frame, and therefore serves as a cover element. A drawback with this structure is the fact that, for example, the frame structure according to FIG. 1 of U.S. Pat. No. 5,316,060 can only be drawn out of the sack with difficulty after the sack has been completely filled, since unwieldy objects or branches can be caught in the U-shaped frame structure.

A similar device for holding sacks or bags open is known from U.S. Pat. No. 4,530,533, in which rectangular frames of assembled plate elements hold open the sack opening, whereby the edges of the sack opening can be drawn through apertures in the frame structure, as a result of which the sack is secured to the frame structure.

From U.S. Pat. No. 4,664,348 a device for holding sacks or bags open is known, which is designed as a ring and can be tensioned into the opening of a sack manufactured especially for the device, and so holds the sack open. This device also has a ramp which serves to allow the sack to be filled more easily. Due to the special design of the sack, the device for holding it open is prevented from falling over.

From U.S. Pat. No. 5,308,027 a device for holding a sack open is likewise known, in which the frame is formed from rods, the sack being clamped between the frame structure and profile rods with a C-shaped cross-section which can be clipped in place. Secured to the lower rod by means of screws is a ramp element for easier filling of the sack. The ramp element serves at the same time to hold the frame element upright, so that the device and the sack secured in it can be set up perpendicular on the ground without the device falling over when the sack is being filled. This structure is not flexible in handling, due to the individual parts being screwed together, and, moreover, the device can easily fall over due to the relatively small surface it stands on.

U.S. Pat. No. 4,765,579 discloses a refuse container, in which a sack can be placed into a container and wherein the sack opening can be folded over to the outside over the upper edge of the container bucket and can be clamped by means of an upper frame, which can be pressed onto the opening of the bucket with its lower circumferential slot, so that the sack is held securely in the refuse container bucket and cannot collapse.

From U.S. Pat. No. 4,759,518 a device for holding sacks open is also known, which has a frame to which the opening of a sack can be secured. On its lower web the device has sharp claw elements which can be inserted into the ground, so that the frame of the device can be secured in its upright position on the ground and does not slip away when the sack being held open is being filled. A disadvantage is that during the filling and transport of the sack the claw elements can lead to injury.

BRIEF SUMMARY OF THE INVENTION

The object of the present invention is to provide a device for holding sacks or bags open which is of small dimensions and which guarantees that the sack is reliably held open and, at the same time, can be set up on the ground at any desired place without falling over, causing the opening of the sack to be closed, while additionally allowing for the sack to be closed.

BRIEF DESCRIPTION OF THE SEVERAL VIEWS OF THE DRAWINGS

FIG. 2: Device for holding sacks open as represented in FIG. 1, with the anchors folded in;

FIG. 3: Side representation of the device for holding sacks open according to the invention, with anchors folded in;

DETAILED DESCRIPTION OF THE INVENTION

Figure 1:
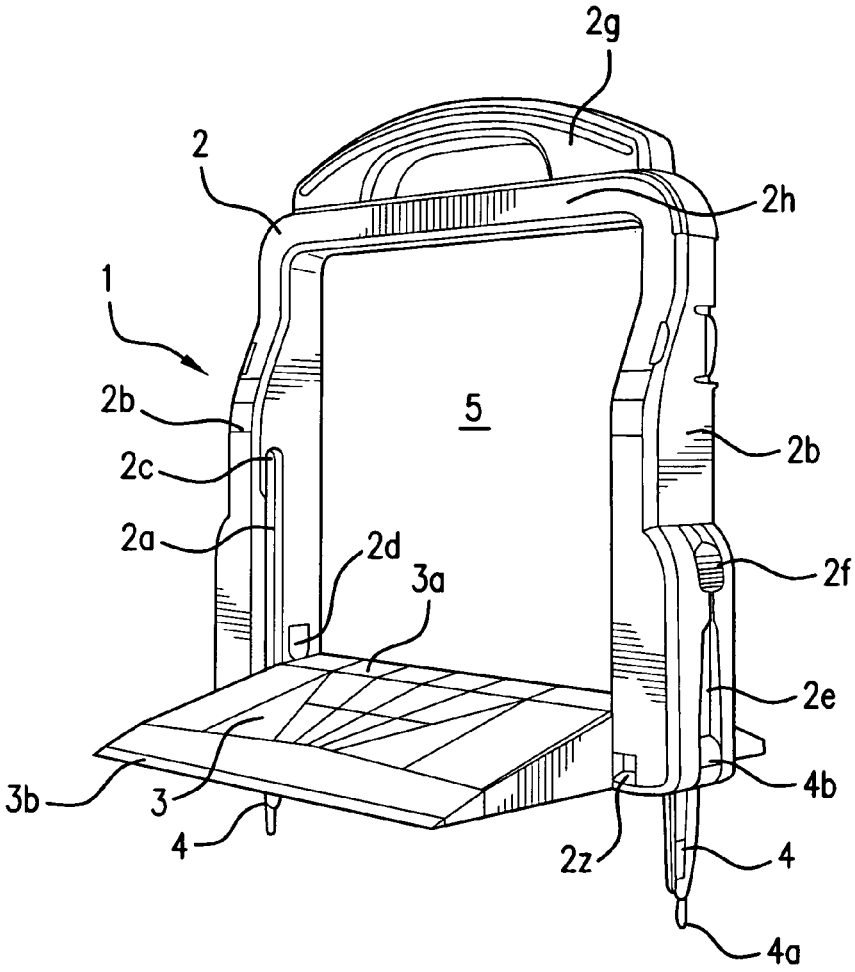
FIG. 1: Perspective view of the device for holding sacks open with the cover element in the second position with the anchors folded out.

This object is achieved according to the invention by a device for holding sacks open with the features of Claim 1. Further advantageous embodiments of the device according to Claim 1 are derived from the features in the sub-claims referring back to Claim 1.

The device for holding sacks open according to the invention is characterised in that it has a cover element which at the same time serves as a filling ramp, cover, and standing surface or standing element. This is achieved according to the invention in that the cover element in its first position is mounted on bearings such that it can be pivoted about an axis on the frame of the device, wherein, due to the pivoting of the cover element, the opening of the frame is exposed and the sack secured to the frame can therefore be filled. By pushing the cover element in a guide device, which is arranged either in the frame or in the cover element, the cover element can be moved from the first position into a second, in which it is held to the frame in a manner secure against rotation, and by which, when the frame is set up in its upright position, it stands with the greatest possible surface area on the ground, so that a large standing surface is provided and great stability for the device can be guaranteed. Due to the large standing surface and the firm connection between the cover element and the frame, the latter is held securely, so that the frame opening of the device when laid on the ground remains in the desired position. Even if, during filling, the unsecured device is touched by the material being filled, such as earth, foliage, and/or branches, it remains advantageously in its original position or location.

In the second position the cover element can optionally be held in place by means of engagement elements or other securing elements. Thus the engagement elements serve a purpose such that only when they are actuated can the cover element be moved out of its second position in the direction of the first element. This ensures a high degree of stability for the device. The cover element, together with the frame, is advantageously designed in such a way that, as far as possible, a positive fit contact prevents the rotation of the cover element into the second position in relation to the frame.

In order for the device with the cover element not to slip on the ground when in the second position, anchors can be arranged on the frame or applied to it, which can be inserted into the earth and so provide additional protection against the device falling over or moving out of position. The anchors can be mounted on bearings so as to pivot about an axis on the frame, as a result of which it is possible for the anchors to be pivoted in a first position, e.g. into an opening or cut-out on the frame, so that during the transport of the device the person carrying it cannot be injured by the anchors. The anchors can be pivoted out of the secure position and, as appropriate, be held by means of securing or engagement devices in a second position, in which they can then be inserted into the earth. The pivoting movement out of the secure position can be supported by spring elements. It is therefore also possible for the spring elements to hold the anchors in the position in which the anchors are inserted into the earth.

It is equally possible, however, for the anchors to be arranged in a displaceable manner on the frame, so that they can be moved out of an opening of the frame. It is also possible for anchors designed as individual components to be secured by means of appropriate securing devices to the frame of the device for holding sacks open.

The cover element is designed advantageously as a ramp, so that the side of the cover element facing away from the sack is, as far as possible, delimited at ground level with its upper part on the ground, and, for example, foliage or other garden waste can be introduced via the ramp and through the opening in the frame into the open sack by means of a rake or broom.

Advantageously the frame has a main part and at least one insert part, the main part having on its underside a recess or slot, in particular circumferential, into which the at least one insertion part can be placed, in particular pressed in, wherein the area of the sack adjacent to the opening can be clamped between the main part and the at least one insertion part, with the result that the sack is held securely at the frame of the device for holding the sack open. The insertion part can, for example, be held in the main part by means of engagement elements. To separate the insertion part(s) from the main part, the engagement elements can be released.

In order to tension the sack, it is optionally possible for tubes or rods to be secured to the underside of the frame, which tubes or rods extend into the sack and tension it. These are advantageously placed in the corners of the frame, in order to tension the sack to the largest volume possible.

It is also possible for the rods to be used as legs. In this situation, the rods can be arranged inside or also outside the sack. If arranged outside the sack, they naturally do not tension the sack open.

In a further advantageous embodiment of the device for holding sacks open according to the invention, it can be secured to a wall, the frame then being secured to a wall horizontally by means of a securing device. By pivoting the cover element in its first position, the opening of the frame can be opened, and waste can therefore be filled into the sack hanging downwards. In addition, it is possible for the cover element of the device secured to the wall to be pivoted and pushed into its second position, so that the opening of the frame is permanently open.

The device for holding sacks open can preferably be made of plastic or aluminium. The material to be used is to be selected on the basis of the demands to be anticipated. It is also conceivable, however, that only certain parts of the device, otherwise made of plastic, are manufactured from metal or composite fibre materials. These may be, for example, the anchor tip or the anchor itself.

It goes without saying that the frame does not have to be designed only as rectangular. Round shapes or, for example, a hexagonal shape, are also possible. Depending on the design of the frame, the cover element is adapted in its shape in such a way that the opening formed in the frame can be closed reliably and completely by the cover element.

A possible embodiment of the device for holding sacks open according to the invention is explained in greater detail hereinafter on the basis of drawings.

FIG. 1 shows a perspective representation of the device 1 for holding sacks open according to the invention, consisting of the frame 2, with the cover element 3 mounted on it in a displaceable and pivotable manner. The frame has two side webs 2*b*, which are connected to one another by webs 2*h* and 2*j* and are aligned parallel to one another. The side webs 2*b* have two longitudinal guides 2*a*, in which the cover element 3 is mounted in a displaceable manner with its projections 3*v*. The one end of the guide 2*a* is designed as a circular bearing 2*c*, so that the cover element, if it has been pushed into this first position, can be pivoted about its transverse axis, as a result of which the opening 5 of the frame of the cover element 3 can be closed. If the cover element 3 has been pushed into its second position (FIG. 1), engagement noses 2*d* spring forwards, which are arranged on the inside of the side webs 2*b*, so that the cover element 3 cannot be displaced in the direction of the bearings 2*c*, without the engagement noses 2*d* being pushed manually into the side webs 2*d*. The cover element 3 is designed as a ramp and has two thin longitudinal sides 3*b*.

The frame has a handle 2*g*, which is secured or can be secured to the web 2*h*.

Mounted so as to be pivotable on the two outer sides of the webs 2*b* are two anchors 4. The anchors 4 each have an anchor tip 4*a*, which can optionally be formed from a metal material, such that, after repeated insertion into the earth, they do not become blunt and/or cannot break off. The anchors 4 can be pivoted about the axis 4*b* into a cut-out 2*e*, an engagement mechanism 2*f* holding the anchor 4, which has been pivoted in, securely in the cut-out 2*e*. When the engagement mechanism 2*f* is actuated, the anchor 4 can be pivoted out of the cut-out 2*e*. The outwards pivoting movement from the cut-out 2*e* can be supported, for example, by a spring, not shown.

Figure 2:
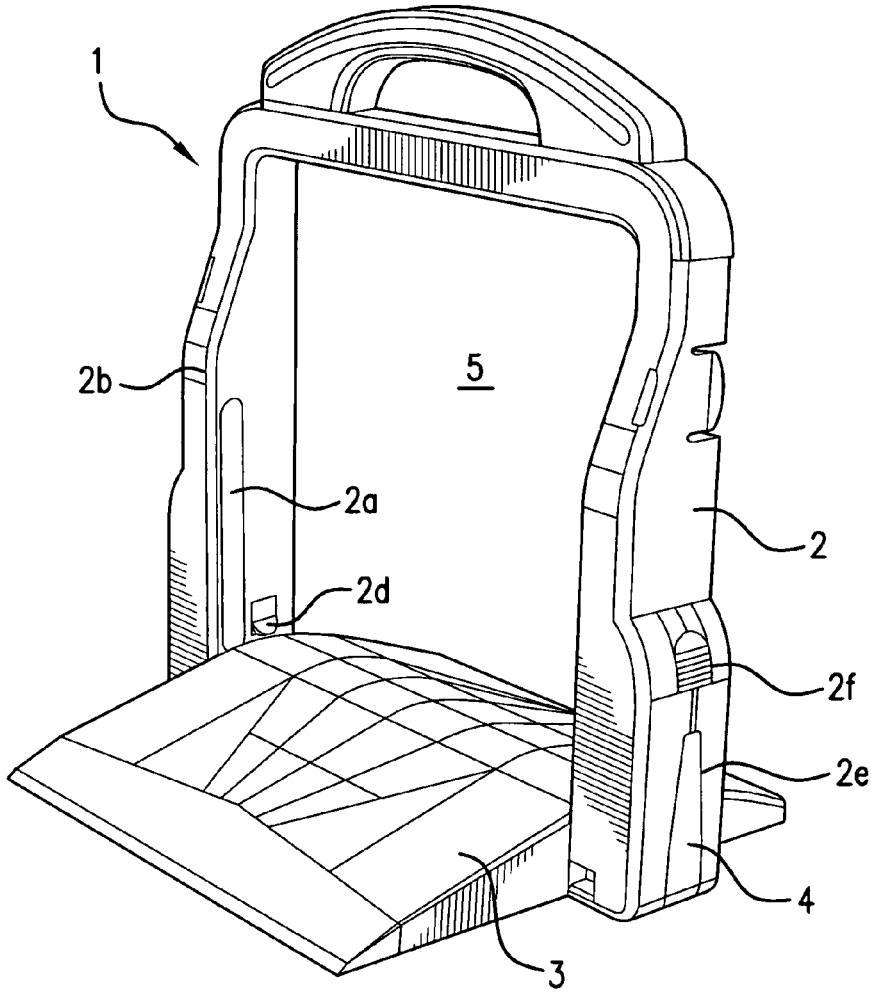

FIG. 2 shows the device 1 for holding sacks open according to FIG. 1 with anchors 4 pivoted into the cut-out 2*e* of the frame.

Figure 3:
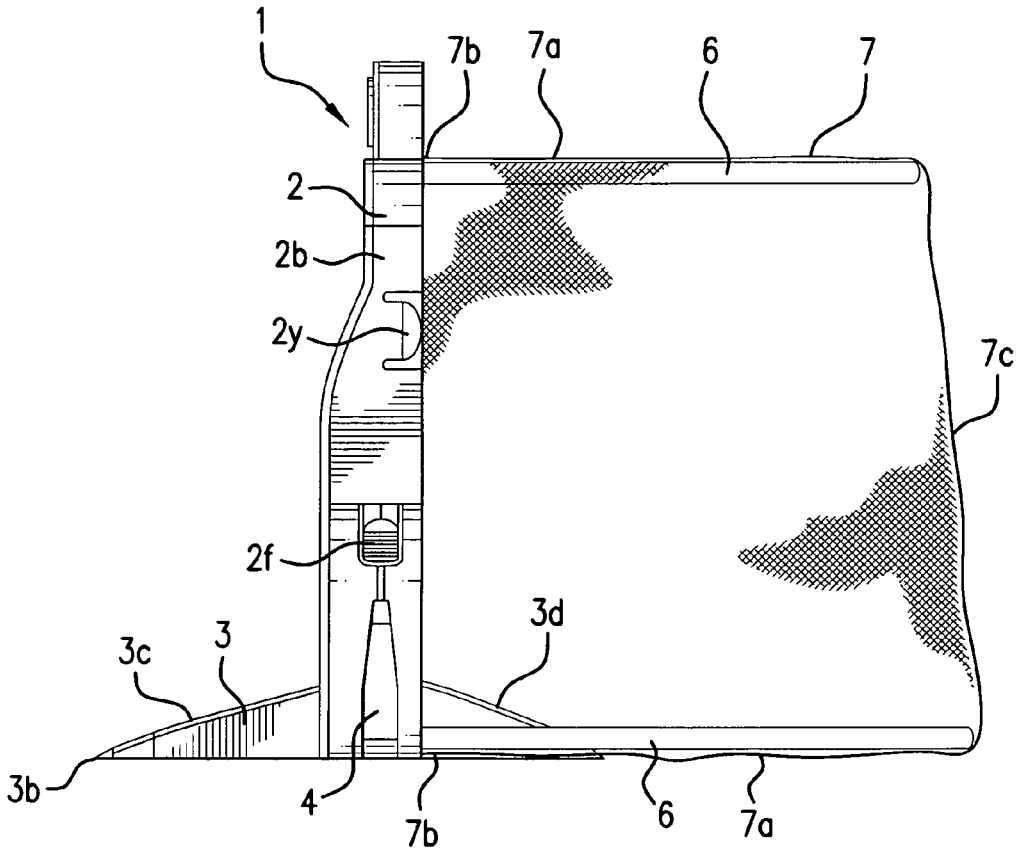

FIG. 3 shows a side view of the device 1 for holding sacks open with a sack 7 secured at the edge, which is tensioned and held open by rods 6, which are secured to the underside of the frame 2. The sack 7 overlaps the rods 6 with its sides 7*a* and its bottom 7*c*, and is held with its opening 7*b* in the frame 2.

Figure 4:
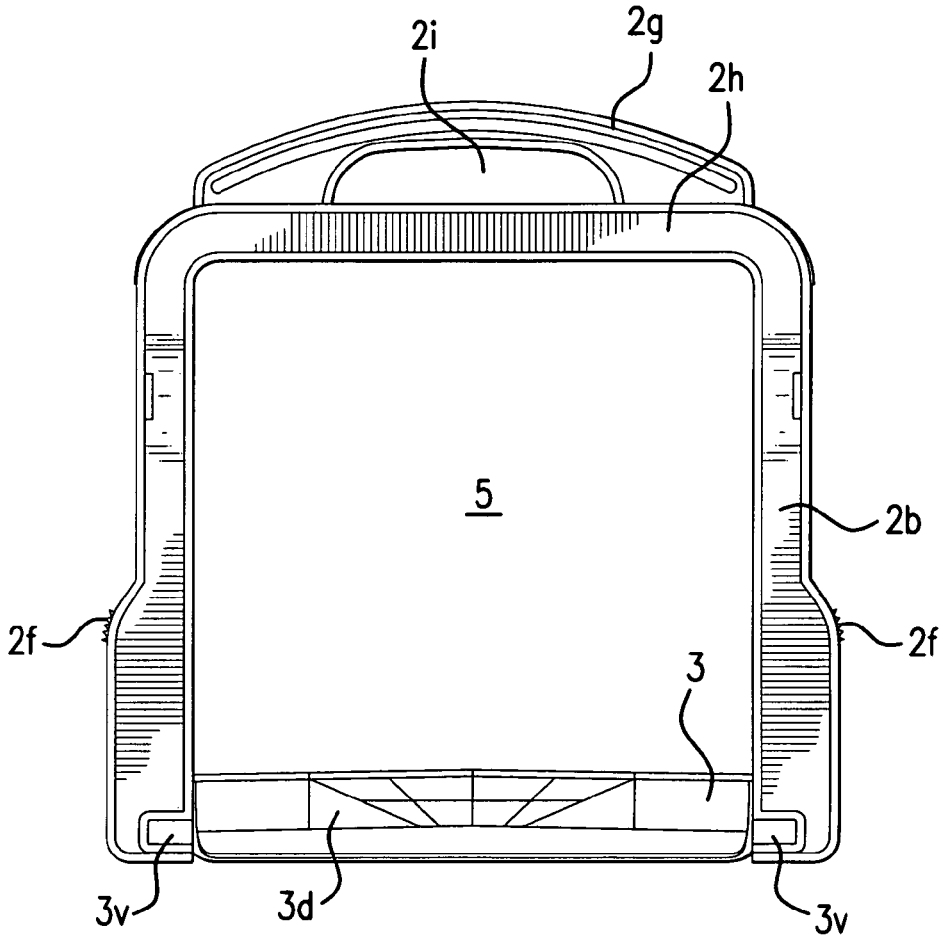
FIG. 4: View from below of the device for holding sacks open, with the cover element in the second position.

FIG. 4 shows a cross-sectional representation through the device 1 for holding sacks open, with its projections 3*v*, which engage into the guides 2*a* of the side webs 2*b*.

Figure 5:
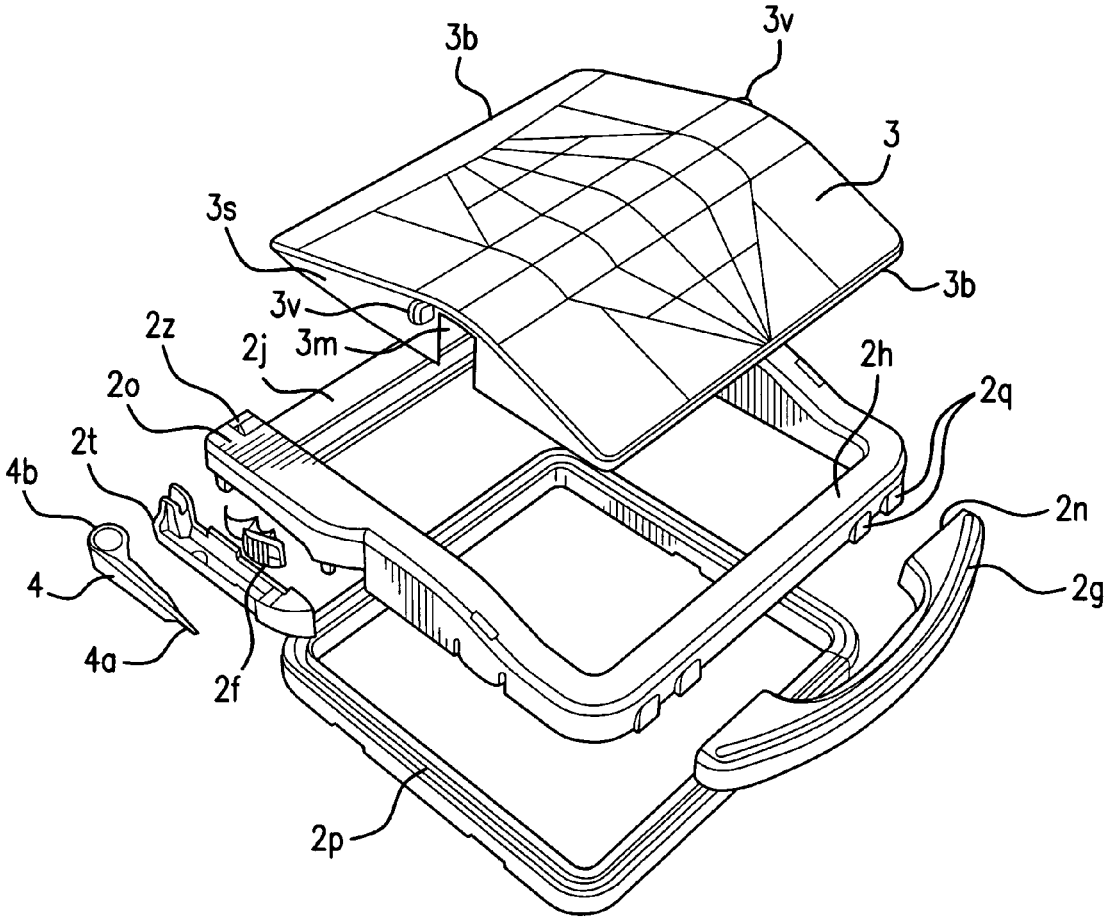
FIG. 5: Exploded view of the device for holding sacks open according to the invention.

FIG. 5 shows an exploded view of the parts of the device 1 for holding sacks open. The cover 3 has projections 3*v*, which are formed laterally on the cover element 3 and form the pivot axis of the cover element 3. The side walls 3*s* of the cover element 3 have openings 3*n*, which are matched by their outer contour to the outer contour of the web 2*j* of the frame 2, so that they engage around this with positive fit, and pivoting and rotation of the cover element 3 relative to the web 2*j* in its second position (FIG. 1) is not possible. At its upper web 2*h* the frame 2 has securing elements 2*q*, which interact with openings 2*r* of the handle element 2*g*, so that the handle element 2*g* can be pushed onto the frame 2 or its securing element 2*q*.

The anchors 4 are mounted on bearings between the push-on part 2*t* and the frame 2, wherein the push-on part 2*t* can be secured to the frame 2 by means of engagement or screw connections.

Figure 6:
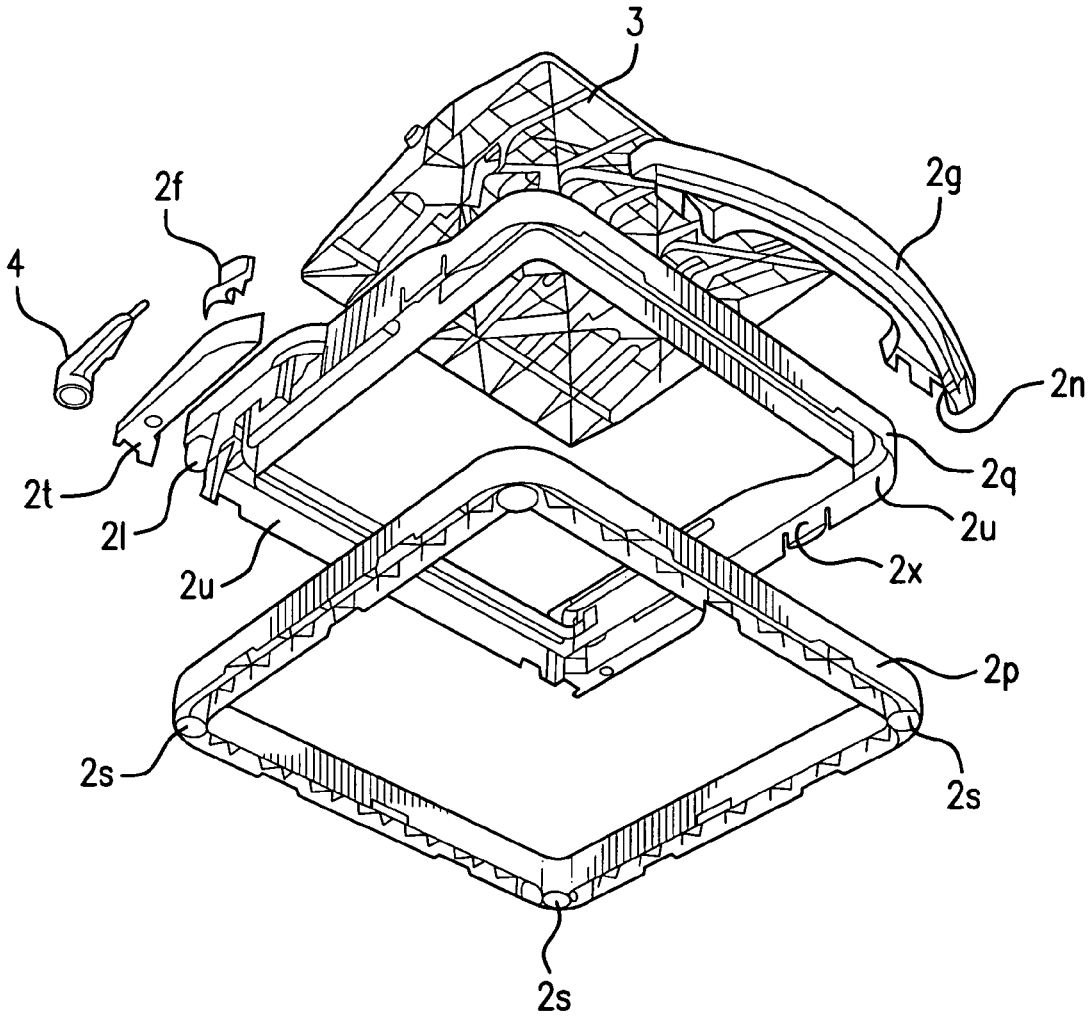
FIG. 6: Exploded view of the device for holding sacks open according to the invention, shown obliquely from below.

As can be seen from FIG. 6, the main part 2*o* has a lower recess 2*u* in the form of a circumferential slot, into which the insertion part 2*p* can be introduced. The sack 7 or its opening 7*b* respectively, can be clamped between the main part 2*q* and the insertion part 2*p*, which is likewise designed as a frame part. The engagement cams 2*x* can be released, for example, by pulling on the unlocking elements 2*y*.

Figure 7:
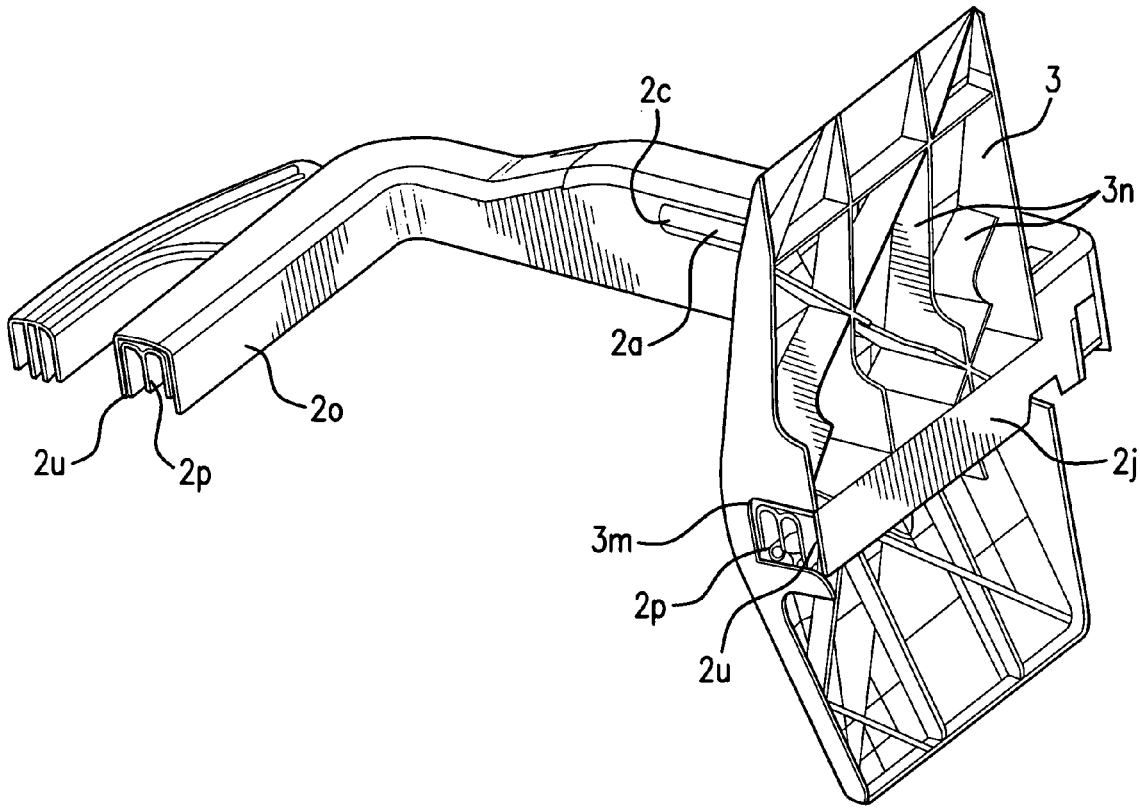
FIG. 7: Sectioned perspective representation of the device for holding sacks open, with the cover element in the second position.
Figure 8:
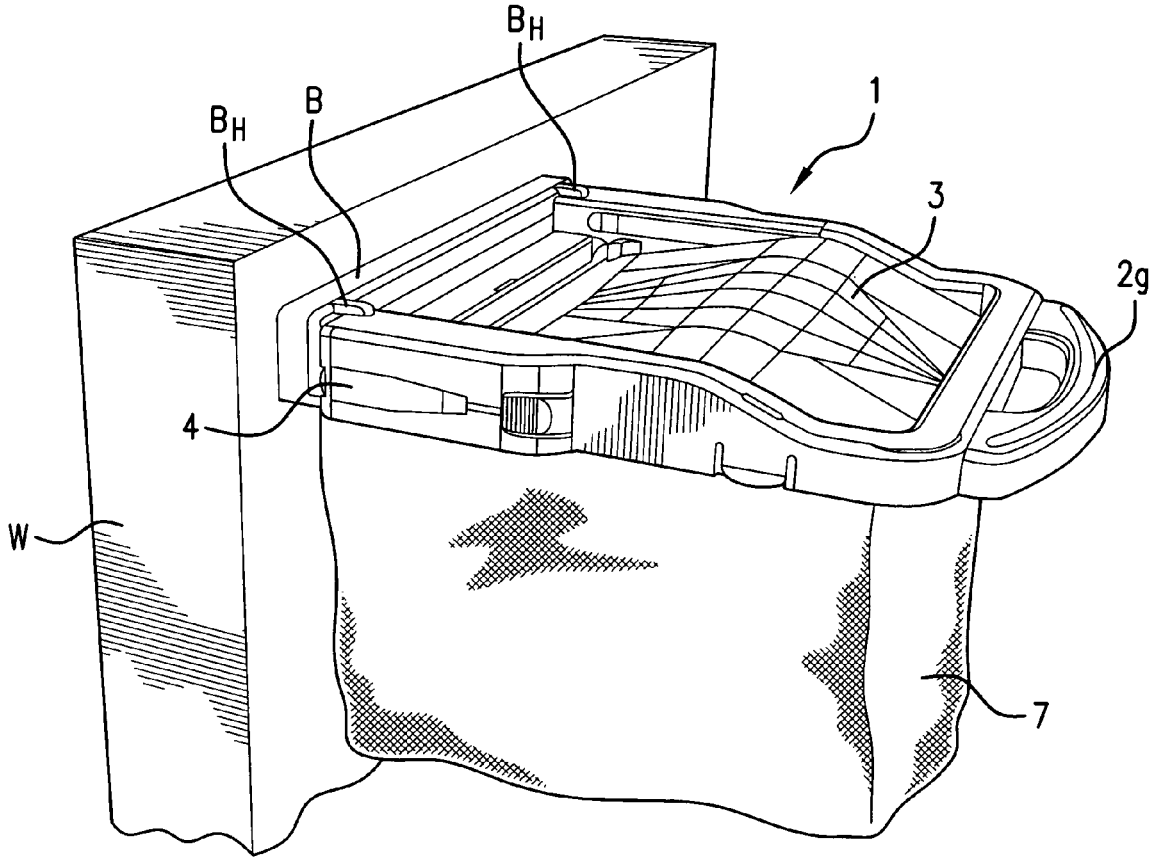
FIGS. 8-11: Device for holding sacks open with wall securing arrangement.

FIG. 7 shows how the cover element 3 in its second position engages with positive fit around the lower web 2*j* of the frame 2 with its slot contour 3*n*, which is formed by a cut-out in the ribs 3*r*. The insertion part 2*p* is located in the main part 2*o*, pressed in from below.

Figure 12:
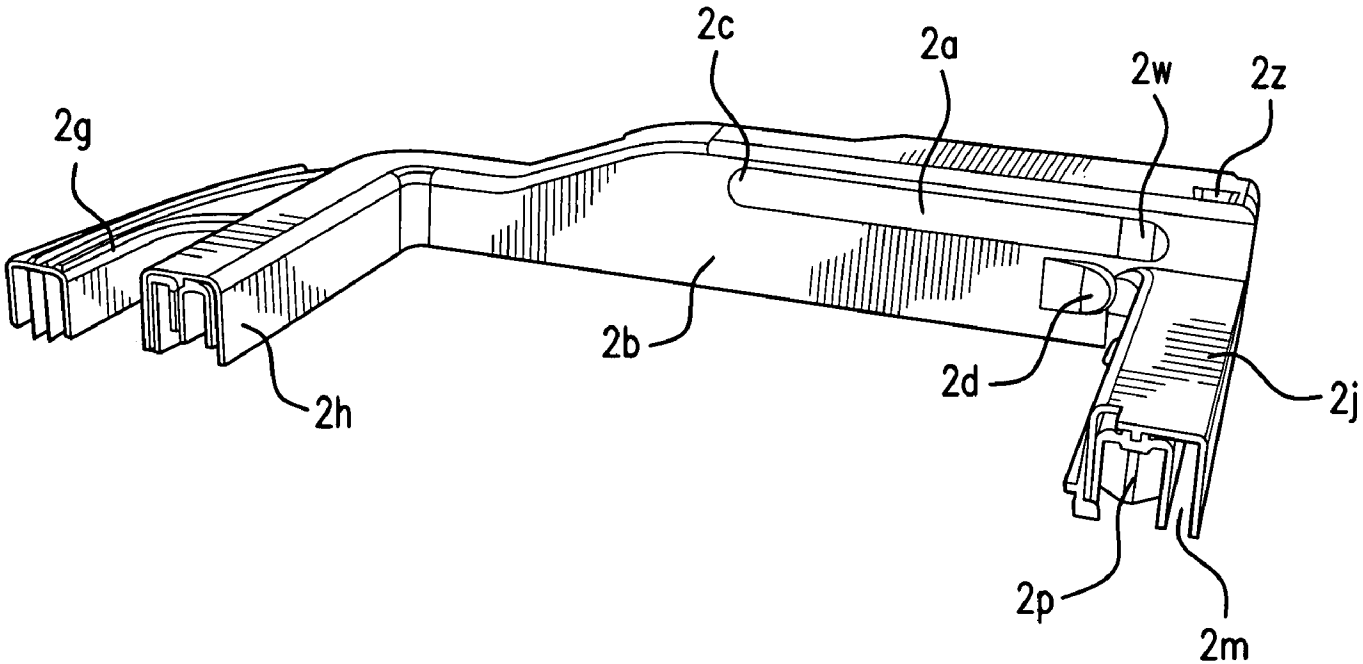
FIG. 12: Sectioned representation of the frame without cover element.

FIG. 12 shows the same sectional representation as FIG. 7, but without the cover element 3.

Figure 9:
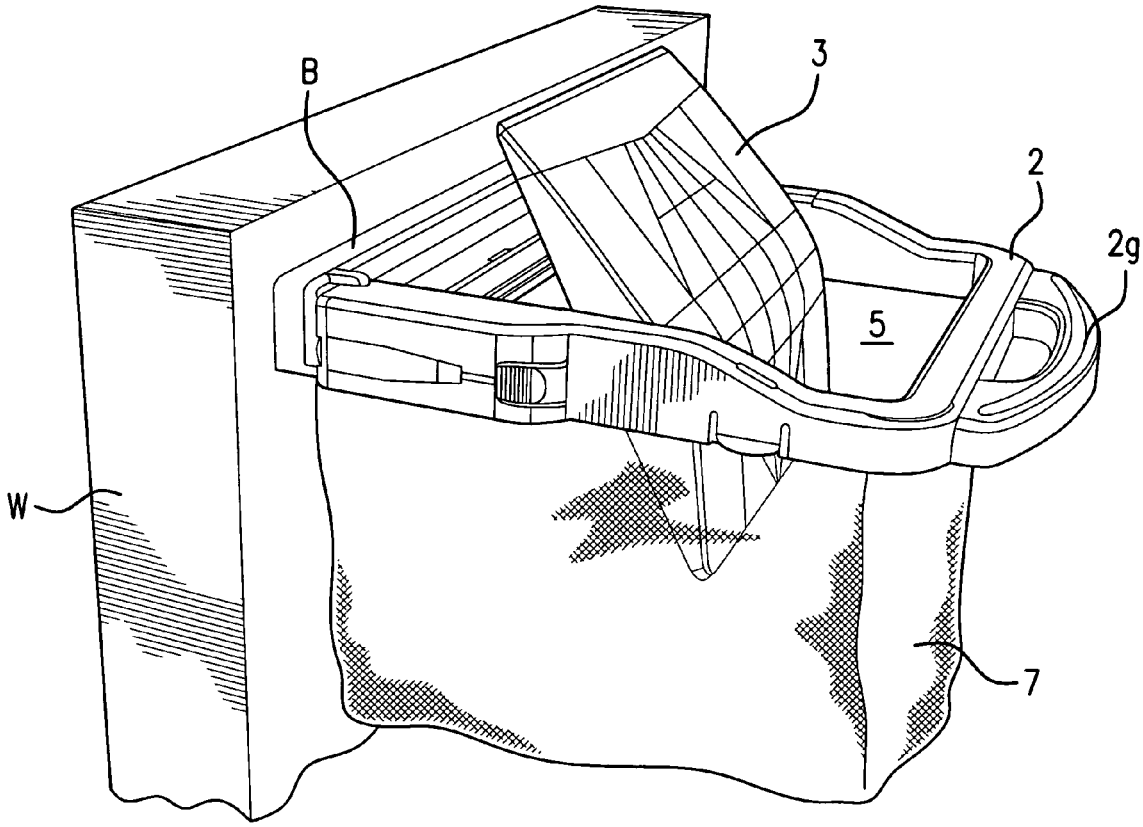
Figure 10:
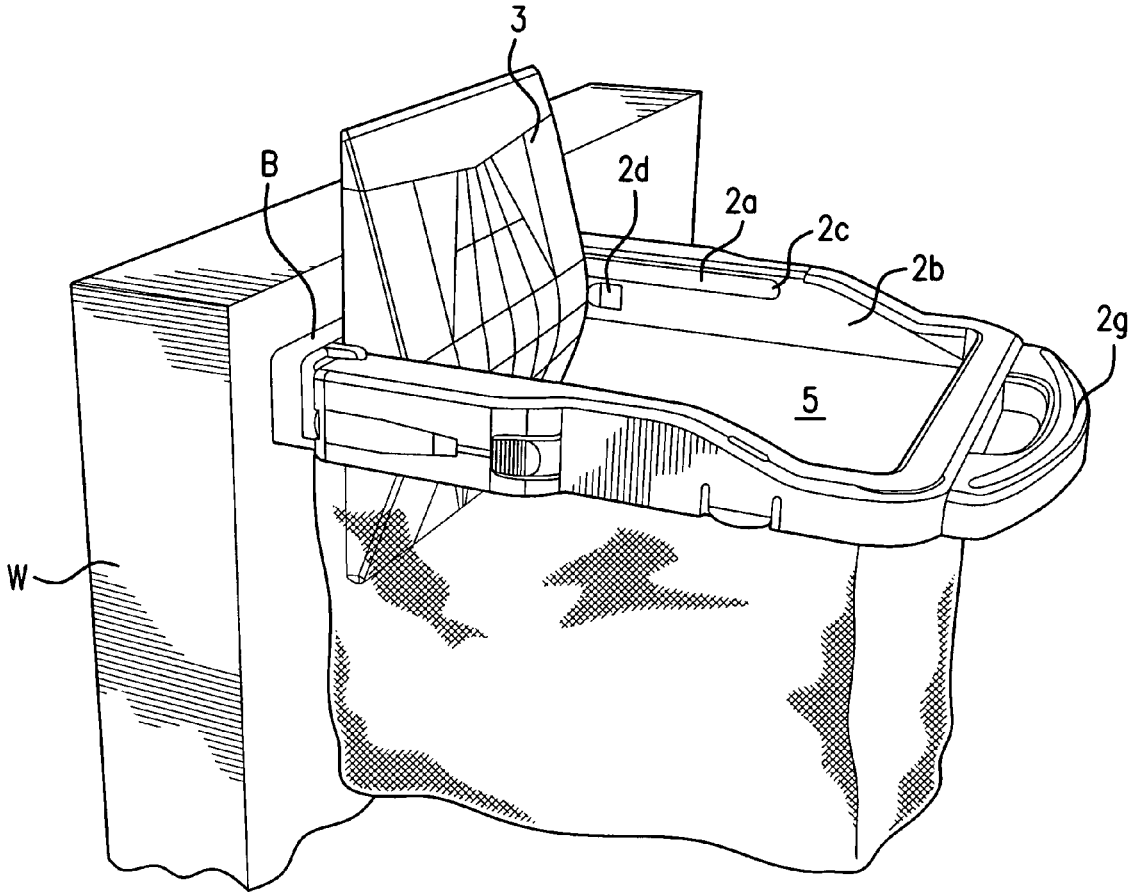
Figure 11:
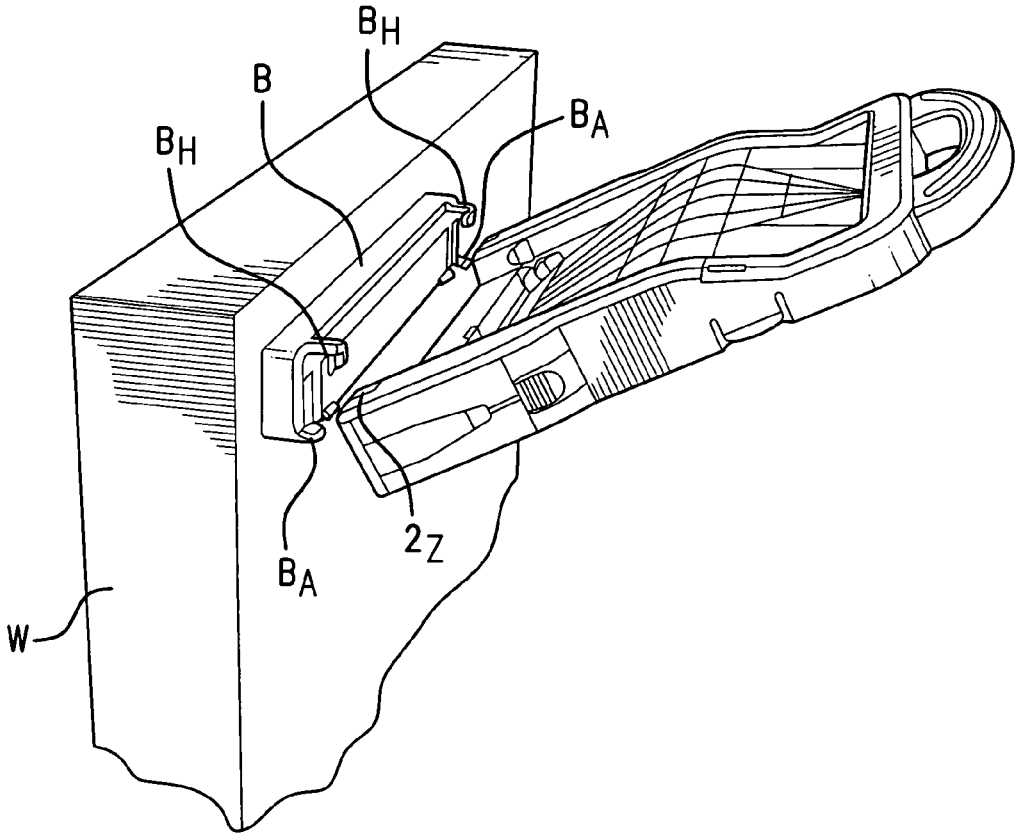

FIGS. 8-11 show the device 1 for holding sacks open according to the invention, which is secured to a wall W by means of the securing element B. The sack 7 is secured in the prescribed manner to the device 1 for holding sacks open. The securing element B, as can be seen in particular from FIG. 11, has upper hooks $B_H$, which engage into the cut-outs 2*z* of the frame 2, and prevent the device 1 for holding sacks open put in position from sliding out. The frame put in position in the securing device B is in contact with its lower side on two contact surfaces $B_A$. As represented in FIG. 11, by rotating the frame 2 in and out, it can be located into the securing device B or taken out of it. As represented in FIGS. 9 and 10, the cover element 3 can either be mounted in the first position (FIG. 9) in a pivotable manner in the frame 2, or, by moving into the position 2 (FIG. 10), the opening 5 of the frame can be permanently opened.

The invention claimed is:

1. Device (1) for holding bags or sacks open, with a frame (2), wherein the frame (2) forms the opening (5) of the device (1) for holding sacks open, said frame having a side web (2*j*), and the opening (5) can be closed by means of a cover element (3), which is mounted in a pivotable manner on the frame (2), characterized in that the cover element (3) can be brought into a first and a second position on the frame, the cover element (3) in the first position being pivotable and optionally closing or exposing the opening (5) of the frame (2), and in that in the second position the cover element (3) serves as a ramp over the side web (2*j*) of the frame (2), with said cover element (3) lying on the ground or placed against a wall or when said device is mounted on a wall, when said cover element (3) is in said second position said cover element (3) is against said wall, and said cover element (3) is held secure against rotation in the frame (2); characterized in that the cover element (3) in the first position can be pivoted about an axis, wherein the axis subdivides the opening (5) of the frame (2) into two opening sections.

2. Device for holding sacks open according to claim 1, characterized in that the frame (2) and/or the cover element (3) has at least one guide element (2*a*), by means of which the cover element (3) can be moved from a first position into a second position.

3. Device for holding sacks open according to claim 1, characterized in that the cover element (3) has on its upper side (3*a*) at least one oblique surface (3*c*, 3*d*), which serves as a ramp.

4. Device for holding sacks open according to claim 3, characterized in that the thickness of the cover element (3) at its free sides, which are arranged parallel to the pivot axis of the cover element (3), increases towards the pivot axis.

5. Device for holding sacks open according to claim 1, characterized in that said device comprises guide element (2*a*) which is formed by means of two longitudinal guides, which are arranged in or at two opposed side webs (2*b*) of the frame (2).

6. Device for holding sacks open according to claim 5, characterized in that the guide elements (2*a*) are longitudinal slots or longitudinal grooves, into which projections (3*v*) of the cover element (3) engage.

7. Device for holding sacks open according to claim 6, characterized in that the guide elements (2*a*) form at one end a circular bearing (2*c*), in such a way that the projections (3*v*) of the cover element (3) can be rotated in these circular bearings about the pivot axis of the cover element (3), the projections (3*v*) being flattened at least on one side in such a manner that only the cover element (3), pivoted in the direction of the perpendicular of the opening (5) of the frame (2), can be pushed with its projections (3*v*) into the guide elements (2*a*).

8. Device for holding sacks open according to claim 6, characterized in that a sack (7) can be secured to the frame (2) by its opening (7*b*).

9. Device for holding sacks open according to claim 8, characterized in that the frame (2) has a main part (2*o*) and at least one insertion part (2*p*), the main part (2*o*) having on its underside a recess (2*u*), into which the at least one insertion part (2*p*) can be inserted, wherein the wall of a sack (7) or bag can be clamped between the main part (2*o*) and the insertion part (2*p*).

10. Device for holding sacks open according to claim 9, characterized in that the insertion part (2*p*) is a rectangular frame, the outer contour of which is shaped to match the inner contour of the recess or the circumferential slot (2*u*) of the main part (2*o*).

11. Device for holding sacks open according to claim 6, characterized in that the cover element (3), has a slot contour (2*n*), in which in the second position a side web (2*j*) of the frame (2) is located in a manner secured against rotation.

12. Device for holding sacks open according to claim 11, characterized in that the cover element (3) has on its underside reinforcement ribs (2*r*) arranged at a distance from one another, which ribs have recesses, which together form the slot contour (2*n*).

13. Device for holding sacks open according to claim 1, characterized in that the cover element has on its underside projections and/or webs, which in the second position are in contact on the sides of the side web of the frame in such a way that rotation of the cover element without prior movement in the guide element is not possible.

14. Device for holding sacks open according to claim 6, characterized in that at least one anchor (4) is or are arranged on the frame (2).

15. Device for holding sacks open according to claim 14, characterized in that the anchors (4) are arranged so as to be pivotable and/or displaceable on the frame (2).

16. Device for holding sacks open according to claim 15, characterized in that in each case at least one anchor (4) is arranged on a side web (2*b*) of the frame (2).

17. Device for holding sacks open according to any one of claims 14 to 16, characterized in that engagement means (2*f*) hold the anchor (4) in its position.

18. Device for holding sacks open according to claim 14, characterized in that the anchor (4) has a tip (4*a*), which is designed to be inserted in the earth, the other end of the anchor (4) having securing means (4*b*) for securing and/or mounting on the frame (2).

19. Device for holding sacks open according to claim 6, characterized in that the frame (2) has a carrying handle (2*g*).

20. Device for holding sacks open according to claim 6, characterized in that the frame (2) has securing means (2*z*) which interact with a wall holding element (B) which can be secured to a wall (W), in such a way that the frame (2) can be secured to a wall (W).

21. Device for holding sacks open according to claim 6, characterized in that rods (6) are secured or can be secured to the frame (2), which rods tension the sack or bag secured to the frame, and/or serve as legs or feet for the device for holding sacks open.

22. Device for holding sacks open according to claim 21, characterized in that in each case a rod (6) is arranged at or in the area of a corner of the frame (2), the rods (6) extending from the frame opening (5).

23. Device for holding sacks open according to claim 6, characterized in that engagement elements (2*d*) hold the cover element (3) in its second position.

24. Device for holding sacks open according to claim 23, characterized in that the engagement elements (2*d*) are arranged on the side webs (2*b*) of the frame (2), which have the guide elements (2*a*).

25. Device for holding sacks open according to claim 6, characterized in that the opening (5) of the frame (2) or frames (2) is itself round, oval, rectangular, or polygonal, in particular hexagonal.

26. The device of claim 8 wherein said sack is secured by being clamped.

27. The device of claim 9 wherein said recess is circumferential.

28. The device of claim 9 wherein said intion is accomplished by being pushed in.

29. The device of claim 10 wherein said insertion part is rectangular.

30. The device of claim 11 wherein said cover element has an underside and said slot contour is on said underside.

31. The device of claim 11 wherein said securing means (2*z*) interacts with wall holding element (B) which can be secured to wall (W), in such a way that the frame (2) can be secured in a horizontal position to said wall (W).

32. The device of claim 22 wherein said rods extend approximately parallel to the normal line of the frame opening (5).

33. Device for holding sacks open according to claim 6, characterised in that (a) at least one anchor (4) can be arranged on the frame (2).

34. Device (1) for holding bags or sacks open, with a frame (2), wherein the frame (2) forms the opening (5) of the device (1) for holding sacks open, said frame having a side web (2*j*), and the opening (5) can be closed by means of a cover element (3), which is mounted in a pivotable manner on the frame (2), characterized in that the cover element (3) can be brought into a first and a second position on the frame, the cover element (3) in the first position being pivotable and optionally closing or exposing the opening (5) of the frame (2), and in that in the second position the cover element (3) serves as a ramp over the side web (2*j*) of the frame (2), with said cover element (3) lying on the ground or placed against a wall or when said device is mounted on a wall, when said cover element (3) is in said second position said cover element (3) is against said wall, and said cover element (3) is held secure against rotation in the frame (2); wherein the cover element (3) has on its upper side (3*a*) at least one oblique surface (3*c*, 3*d*), which serves as a ramp, and the thickness of the cover element (3) at its free sides, which are arranged parallel to the pivot axis of the cover element (3), increases towards the pivot axis.

35. Device (1) for holding bags or sacks open, with a frame (2), wherein the frame (2) forms the opening (5) of the device (1) for holding sacks open, said frame having a side web (2*j*), and the opening (5) can be closed by means of a cover element (3), which is mounted in a pivotable manner on the frame (2), characterized in that the cover element (3) can be brought into a first and a second position on the frame, the cover element (3) in the first position being pivotable and optionally closing or exposing the opening (5) of the frame (2), and in that in the second position the cover element (3) serves as a ramp over the side web (2*j*) of the frame (2), with said cover element (3) lying on the ground or placed against a wall or when said device is mounted on a wall, when said cover element (3) is in said second position said cover element (3) is against said wall, and said cover element (3) is held secure against rotation in the frame (2); said device comprises guide element (2*a*) which is formed by means of two longitudinal guides, which are arranged in or at two opposed side webs (2*b*) of the frame (2).

36. Device (1) for holding bags or sacks open, with a frame (2), wherein the frame (2) forms the opening (5) of the device (1) for holding sacks open, said frame having a side web (2*j*), and the opening (5) can be closed by means of a cover element (3), which is mounted in a pivotable manner on the frame (2), characterized in that the cover element (3) can be brought into a first and a second position on the frame, the cover element (3) in the first position being pivotable and optionally closing or exposing the opening (5) of the frame (2), and in that in the second position the cover element (3) serves as a ramp over the side web (2*j*) of the frame (2), with said cover element (3) lying on the ground or placed against a wall or when said device is mounted on a wall, when said cover element (3) is in said second position said cover element (3) is against said wall, and said cover element (3) is held secure against rotation in the frame (2); the cover element has on its underside projections and/or webs, which in the second position are in contact on the sides of the side web of the frame in such a way that rotation of the cover element without prior movement in the guide element is not possible.

* * * * *

UNITED STATES PATENT AND TRADEMARK OFFICE

CERTIFICATE OF CORRECTION

PATENT NO. : 7,975,732 B2
APPLICATION NO. : 11/821218
DATED : July 12, 2011
INVENTOR(S) : Reinhard Schoeniger It is certified that error appears in the above-identified patent and that said Letters Patent is hereby corrected as shown below:

Title Page, Item (12), "Schoniger" should read --Schoeniger--.

Title Page, Item (75), correct the Inventor's Name by deleting the misspelled name "Reinhard Schoniger" and inserting in place thereof the correctly spelled name --Reinhard Schoeniger--.

Title Page, Item (73), correct the Assignee's Name by deleting the misspelled name "Italia Stampa s.r.l." and inserting in place thereof the correctly spelled name --Italia Stampi s.r.l.--.

Signed and Sealed this
Twenty-ninth Day of October, 2013

Teresa Stanek Rea

Teresa Stanek Rea
*Deputy Director of the United States Patent and Trademark Office*